US006641513B1

(12) United States Patent
Ward et al.

(10) Patent No.: US 6,641,513 B1
(45) Date of Patent: Nov. 4, 2003

(54) WEB-HANDLING ROLLER

(75) Inventors: James K. Ward, Rockton, IL (US); Roger Cederholm, Roscoe, IL (US)

(73) Assignee: Martin Automatic Inc., Rockford, IL (US)

( * ) Notice: Subject to any disclaimer, the term of this patent is extended or adjusted under 35 U.S.C. 154(b) by 0 days.

(21) Appl. No.: 09/937,025

(22) PCT Filed: Apr. 7, 2000

(86) PCT No.: PCT/US00/09337

§ 371 (c)(1),
(2), (4) Date: May 20, 2002

(87) PCT Pub. No.: WO00/61481

PCT Pub. Date: Oct. 19, 2000

Related U.S. Application Data

(60) Provisional application No. 60/128,589, filed on Apr. 9, 1999.

(51) Int. Cl.[7] ..... B23P 15/00

(52) U.S. Cl. ..... 492/59; 492/4

(58) Field of Search ..... 492/59, 4; 29/895.1, 29/895.21, 895.23; 226/190, 191, 194; 242/615.2

(56) References Cited

U.S. PATENT DOCUMENTS 3,746,233 A * 7/1973 Bauer et al. ..... 226/194
3,757,399 A * 9/1973 Hanssen ..... 226/194
4,552,295 A * 11/1985 Smith et al. ..... 226/180
5,133,187 A * 7/1992 Beaudreault et al. ..... 60/533
5,246,155 A * 9/1993 Barrois ..... 226/190
5,497,549 A * 3/1996 Rademacher ..... 29/895.21
5,702,045 A * 12/1997 Tschirner ..... 226/191
5,953,992 A * 9/1999 Calloway ..... 101/351.7
5,987,748 A * 11/1999 Calloway ..... 29/895.21
6,386,103 B1 * 5/2002 Charette et al. ..... 101/375
6,394,943 B1 * 5/2002 Cormier et al. ..... 492/47

* cited by examiner

*Primary Examiner*—I Cuda Rosenbaum
(74) *Attorney, Agent, or Firm*—McAndrews, Held & Malloy, Ltd.

(57) ABSTRACT

A low inertia, low friction roller (12), which is particularly adapted for handling relatively high speed, relatively fragile running webs, comprises an inner tube (16) and an outer tube (14). The outer tube (14) is disposed substantially coaxially about the inner tube (16) and is rotatable with respect to the inner tube (16). An annular gap (46) is defined between the inner and outer tubes and has a first portion that is supplied with a restricted flow of a pressurized compressible fluid and that is adjacent the portion of the outer tube about which the web passes. A second portion of the annular gap is circumferentially spaced from the first portion of the annular gap and communicates with a fluid exhaust passage (66) in the inner tube. The dimensions of the annular gap are selected so that the fluid pressure in the first portion is greater than the fluid pressure in the second portion and so that the pressure of the fluid in the first portion of the annular gap will substantially balance the force exerted by the web on the outer tube as the web passes about the outer tube. The Figure shows an enlarged, partial cross-sectional view.

21 Claims, 3 Drawing Sheets

WEB-HANDLING ROLLER

CROSS REFERENCE TO RELATED APPLICATIONS

The present application is based on and claims priority from U.S. provisional application Serial No. 60/128,589, filed Apr. 9, 1999, titled "Improved Web-Handling Air Roller", which application is incorporated herein in its entirety by reference.

BACKGROUND OF THE INVENTION

The present invention relates generally to rollers for handling moving webs of various materials, and more specifically, to improved low inertia rollers particularly adapted for handling relatively high speed, relatively fragile webs, such as webs of nonwoven materials utilized in the manufacture of disposable diapers and the like.

Manufacturers, whose processes involve web handling, seemingly continually seek higher web processing speeds. Disposable diaper manufacturers are illustrative of such manufacturers since increasing the speed of the webs utilized in making disposable diapers can significantly reduce manufacturing costs on a per diaper basis. The webs used in manufacturing disposable diapers, especially the webs of nonwoven materials, tend to be relatively fragile, and this has often limited the forces that can be exerted in the webs during handling.

In many manufacturing processes involving web handling, webs are introduced into the process from a roll of the web material. Zero-speed splicers are often used to splice the beginning end of the web from a new roll onto the trailing end of an expiring roll. For the zero-speed splicer to work appropriately, the travel speed of the moving web at the splicing point must be brought to zero. After the webs are then spliced together, the web is subsequently accelerated back up to the desired web processing speed.

Rollers are commonly used for the handling and conveyance of web materials, such as webs of nonwoven, plastic, paper, filter and film materials, from one point in a manufacturing process to another. The surfaces of web-handling rollers are usually shaped to a desired profile and are typically required to be rigid. This is because surface imperfections and flexure in web rollers may lead to wrinkles and other imperfections in the web. To maintain the required rigidity and surface requirements, prior web rollers have typically been made from relatively heavy material, such as steel. As a result, such web rollers have a substantial amount of inertia.

To attempt to handle high-rate speed changes with high-inertia rollers, especially in processes including zero speed web splicers, the web handling processes have been required to use extra equipment, including control systems, power supplies and prime movers. This equipment is generally relatively expensive and also requires space on the already crowded, short-of-space manufacturing floor. Also, relatively large amounts of energy must be expended to control the motion of high-inertia rollers.

In addition, such standard web rollers have also required relatively heavy bearings for support. Heavy bearings, in turn, have a substantial amount of friction. The bearing friction continually acts against the acceleration of the web roller. To counteract the bearing friction in standard web rollers, the web handling process requires higher powered equipment and larger amounts of energy than would be required with a low-friction roller.

It has been proposed to convey web material by supporting the web material directly using forced air. For instance, U.S. Pat. No. 5,360,152 describes a cylinder with an outer surface that is perforated with multiple openings to form a bearing or gliding surface for the web material. A disadvantage, however, to supporting the web material directly with air is that many web materials, such as nonwovens, are porous, and supporting a porous web directly with forced air is ineffective. Another disadvantage is that many web processes require the support of flat and rigid roller surfaces to reduce wrinkling and other web imperfections. Air fails to provide the levels of support typically provided by rigid roller surfaces.

Others have suggested using a fluid (including air) to support a web guide roller. U.S. Pat. No. 5,246,155discloses a roller that includes end seal covers and a support body generally in the shape of a hollow pipe. A thin, cylindrical roller body is carried by and is concentric with the support body. The annular space between the roller body and the support body is filled with a suitable pressure fluid, such as oil. The patent, however, also mentions air as a possible fluid. The pressure fluid is introduced into annular space by a plurality of equi-radially spaced and disposed feed lines, and is withdrawn from the annular space primarily through deflector channels disposed at the ends of the support body. Although the patent states of that the roller body is allowed to rotate with respect to the roller support body in an essentially frictionless manner, this statement must be questioned. With the pressure fluid exerting the same pressure throughout the annular space on the roller body the force exerted by the web, as it passes about a portion of the roller body, would cause the portion of the roller body to be moved into friction contact with adjacent portion of the roller support body. Such contact may be said to be essentially frictionless in the context of a printing press employing a paper web, and particularly when oil is the pressure fluid. However, if air were to be employed, the frictional contact would render the patented web guide roller unusable, particularly if attempts were made to use the patented web guide roller to handle relatively high speed, relatively fragile webs, such as used in the manufacture of disposable diapers.

Those working in the art of handling relatively high speed, relatively fragile webs have long recognized that a need existed for an improved web-handling roller that has low inertia and low friction and that is capable of providing rigid support for such webs.

SUMMARY OF THE INVENTION

An object of the present invention is to provide a web-handling roller that has relatively low inertia and relatively low friction and that may be used in handling relatively high speed, relatively fragile webs, such as the webs utilized in the manufacture of disposable diapers and the like. A further object of the present invention is to provide a low inertia, web-handling roller that provides rigid web support for such webs.

The foregoing objects are met in whole or in part by the present invention that provides an improved low inertia roller adapted for handling relatively high speed, relatively fragile webs, such as webs utilized in the manufacture of disposable diapers and the like. The improved roller includes a relatively fixed, inner tube. This inner tube has a radially outwardly facing surface, first and second ends, and a longitudinal central axis. A web contacting outer tube, which also has first and second ends, and a longitudinal central axis, is disposed about the inner tube so that the longitudinal central axes of the inner and outer tubes are coaxial and so that the outer tube may rotate about the coaxial central axes with respect to the inner tube, with minimal friction therebetween. The outer tube has radially outwardly facing and radially inwardly facing surfaces. The inwardly facing surface of the outer tube and the outwardly facing surface of the inner tube define an annular gap or space therebetween that has a preselected radial thickness or dimension. The annular gap has a first, partially circumferentially extending portion, adjacent the partially circumferentially extending portion of the outer tube, which is adapted to be in contact with a web as the web passes about the roller. The annular gap also has a second, partially circumferentially extending portion spaced circumferentially from the first portion. Longitudinally extending grooves in the inner tube are adjacent the first and second portions and may constitute parts of the portions. The inner tube has a first fluid passage that is in fluid communication with a source of pressurized compressible fluid. A second fluid passage in the inner tube is adapted to exhaust compressible fluid from the inner tube, and is in fluid communication with the second portion of the annular gap. A fluid flow restriction device in the inner tube includes a restricted fluid flow path that permits the flow of compressible fluid, in a preselectedly restricted manner, from the first passage to the first portion of the annular gap. The radial dimension of the annual gap, between the first and second portions, is selected so that there is a reduction in the pressure of the compressible fluid as the fluid passes from the first portion of the annular gap to the second portion of the annular gap and so that the force of the web passing around the outer tube is substantially balanced by the pressure of the compressible fluid in the first portion of the annular gap.

In addition to the low inertia and relatively low friction running, the improved roller of the present invention includes what can be described as a "feedback system" feature. Due to the functioning of the air gap, which causes a difference (decrease) in the fluid pressures between the first and second portions of the air gap, the force that is exerted by a web on the outer tube is always countered by the force exerted by the fluid in the first portion of the annular gap.

These and other objects and advantages of the present invention will become apparent to those of skill in this art from the following description of the preferred embodiment of the present invention including the drawings.

Figure 1:
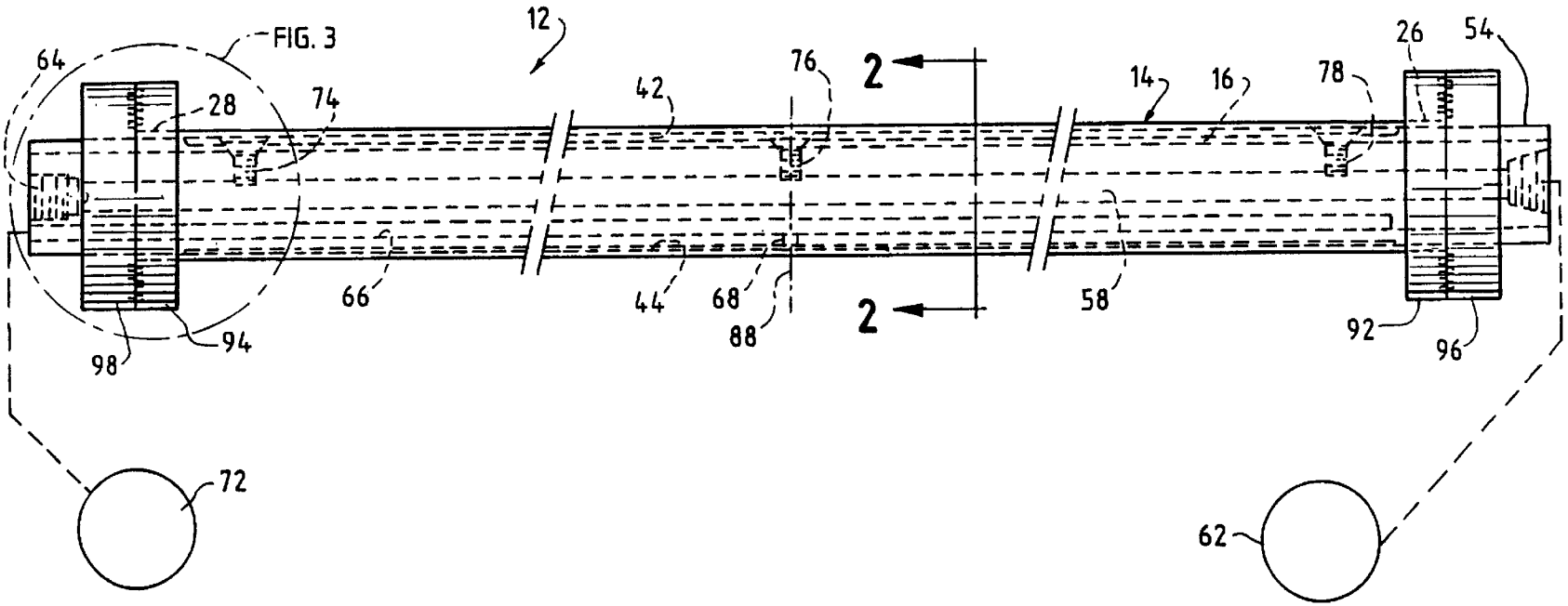
FIG. 1 is a side view of an improved roller of the present invention.

In the following detailed description of the preferred embodiment, spatially orienting terms such as "upper," "lower," "left," "right," "vertical," "horizontal,"and the like, are used. It is to be understood, however, that these terms are used for convenience of description of the preferred embodiment with reference to the views shown in the drawings. These terms do not necessarily describe the absolute location in space, such as left, right, upward, downward, etc., that any part must assume in use.

DESCRIPTION OF THE PREFERRED EMBODIMENT

Figure 2:
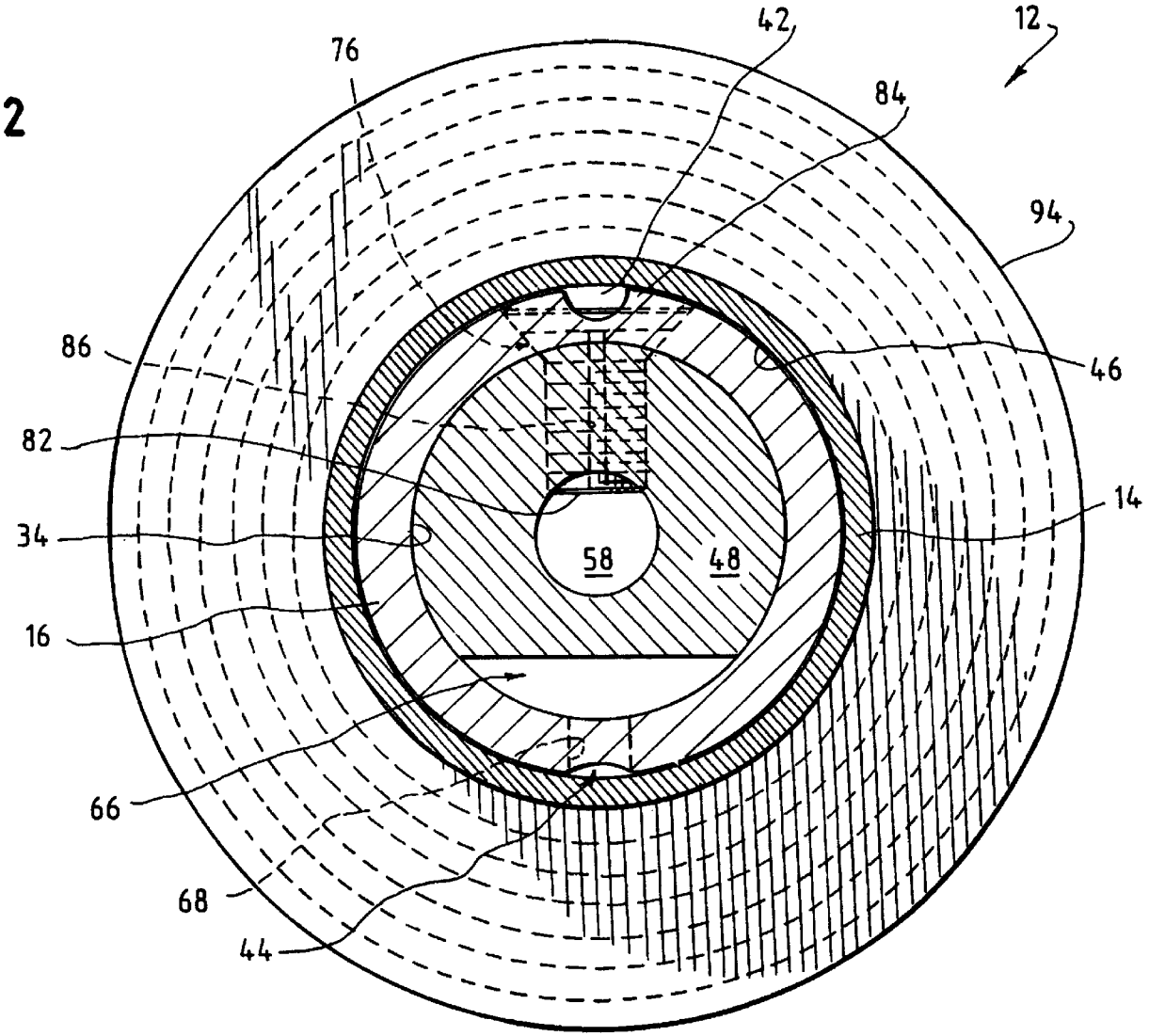
FIG. 2 is a partial cross-sectional view taken along the line 2—2 of FIG.1.
Figure 3:
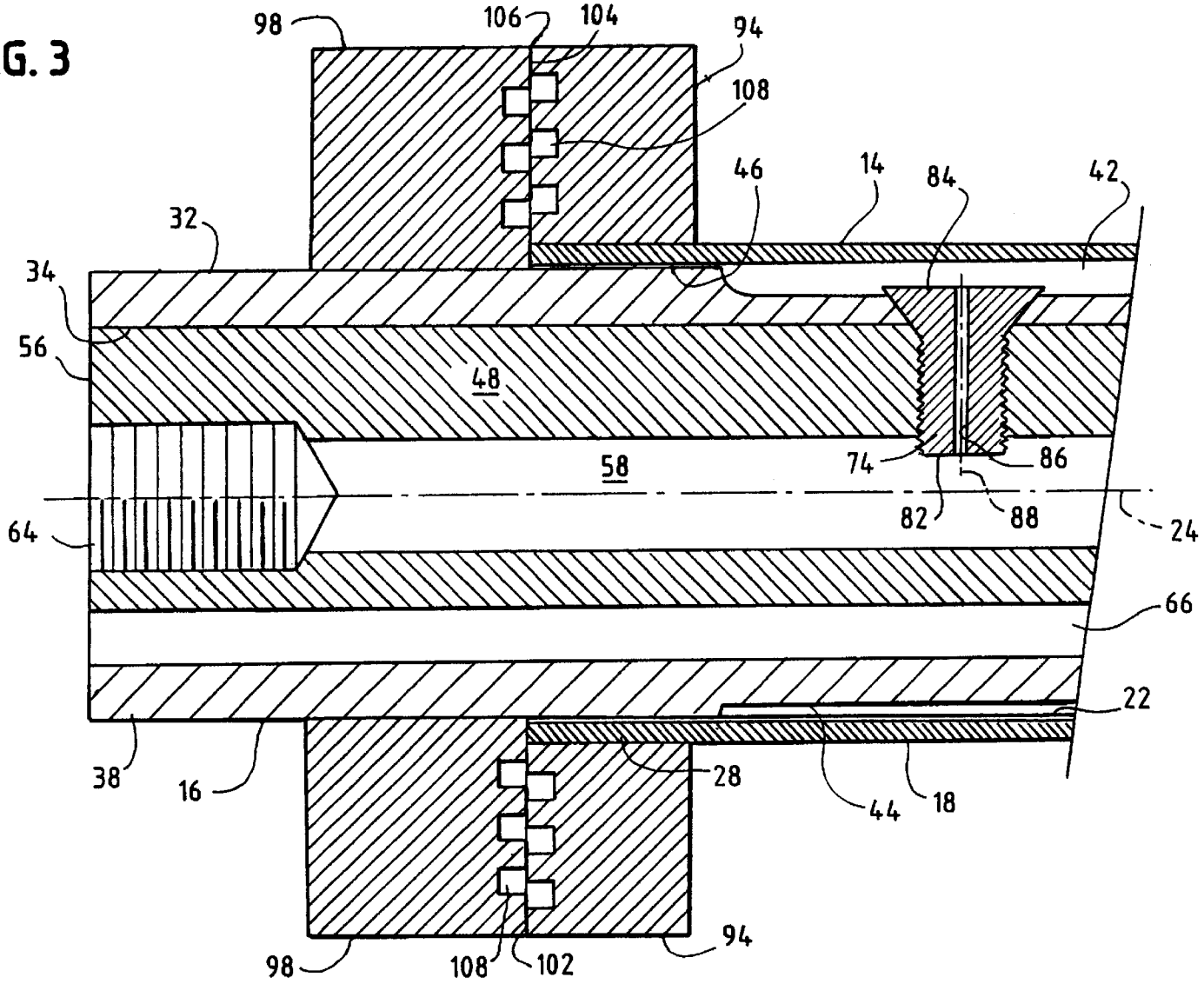
FIG. 3 is an enlarged, partial cross-sectional view, like the view of FIG. 2, of the portion of the roller indicated by line. 3 in FIG. 1.

Referring now to FIGS. 1–3, an improved roller 12 of the present invention includes an outer tube 14 and an inner tube 16. The outer tube 14 is hollow and generally cylindrical in shape. Tube 14 has a radially outwardly facing surface 18, a radially inwardly facing surface 22 and a longitudinal central axis 24 that extends between its longitudinal ends 26 (right) and 28 (left), as shown in FIGS. 1 and 2. The outer tube 14 is preferably constructed from a lightweight rigid material, such as, for example, carbon fiber. The outer tube may, however, also be constructed from other plastics and metals materials having similar properties.

The inner tube 16 has a substantially cylindrical, radially outwardly facing surface 32, a radially inwardly facing surface 34, and a longitudinal central axis that is coaxial with the axis 24 of the outer tube 14. The inner tube 16 is disposed within the outer tube 14 so that the outer tube may freely rotate, about its longitudinal axis 24, with respect to the relatively "fixed" tube 16. The length of the inner tube 16 is greater than that of the outer tube 14 so that the ends 36 (right) and 38 (left) of the tube 16 extend beyond the ends 26 and 28, respectively, of the tube 14. The inner tube 16 may be made from stainless steel or another material having similar properties.

As shown in FIGS. 1–3, the inner tube 16 has a first, longitudinally extending upper groove 42 in the upper or top part of its outwardly facing surface 32. This groove 42 has a longitudinal axis, which is parallel to the longitudinal axis 24, and a length that is substantially the same as, but shorter than, the length of the outer tube 14 so that the ends 26 and 28 of the outer tube extend slightly beyond the respective ends of the longitudinal groove 42.

As again shown in FIGS. 1 and 2, a second, longitudinally extending groove 42 is in the lower or bottom part of the outwardly facing surface 32. Like groove 42, the central longitudinal axis of the groove 44 is parallel with the axis 24. The length of the groove 44 is substantially the same as that of the groove 42. As shown in FIG. 2, the grooves 42 and 44 are diametrically opposed vis-a-vis the axis 24. The grooves 42 and 44 have a generally semi-circular cross-section, in a plane perpendicular to the axis 24, and open radially outwardly or, toward the inwardly facing surface 22 of the outer tube 14.

The radial dimensions of the inwardly facing surface 22 of the outer tube 14 and the outwardly facing surface 32 of the inner tube 16 are selected so that when assembled, as shown in FIGS. 1–2, an annular gap or space 46 exists between the surfaces 22 and 32. As more fully explained hereinafter, this annular gap 46 is present along the length of the tube 16 from adjacent the end 36 to adjacent the end 38.

A generally cylindrical (except as noted hereinafter) insert member 48 is disposed or positioned within the inner tube 16 and has radially outwardly facing surface 52. The radial dimensions of the surface 52 and inwardly facing surface 34 of the tube 16 are selected so that a tight, surface-to-surface contact (again, except as hereinafter noted) exists between the surfaces 34 and 52. The length of the member 48 is the same as that of the inner tube 16 and its ends 54 (right) and 56 (left) are flush with the ends 36 and 38, respectively, of the tube 16. The central longitudinal axis of the member 48 is coaxial with the axis 24. The member 48 may be made from a plastic material, such as "Delrin" (or "Black Delrin") or any other material having similar properties.

The member 48 includes a central longitudinal passage 58 that extends between the ends 54 and 56. One end (the end 54 as shown in FIG. 1) communicates with a source of pressurized compressible fluid 62. This compressible fluid is preferably compressed air under a pre-selected pressure. The other end (the left end 56 as shown in FIG. 1) of the passage 58 is closed, for example, by a plug 64.

The member 48 also includes a second longitudinal fluid passage 66 which, as shown in FIG. 2, may be defined by a flat on the member 48 and by the inwardly facing surface 34 of the tube 16. The second passage 66 is adjacent to the second groove 44 in the lower or bottom part of the member 48. A radially directed, third passage 68 in the tube 16 permits fluid communication between the second passage 66 and the second groove 44. The radial passage 68 is located substantially midway between the ends 36 and 38.

One end of the passage 66 (that is, the end adjacent to the end 56 of the member 48) is in fluid communication with a sump 72 to which fluid in the passage 66 may be exhausted. The other end of the passage 66 (that is, the end adjacent to the end 54) is blocked.

Fluid communication between the central passage 66 and the groove 42 is afforded by a fluid flow restriction device, three of which are indicated by reference numbers 74, 76 and 78 in FIG. 1. As shown in FIG. 1, the devices 74 and 78 are disposed or positioned adjacent the left and right ends, respectively, of the groove 42, and the device 76 is adjacent to the center of the groove 42. Each of these devices 74, 76 and 78 are structurally and functionally identical. For this reason, only device 74 will be described in detail, although in the drawings, the same reference numerals being applied to all the devices.

More specifically, the device 74 is threaded secured, by conventional threads to the tube 16 and the member 48. The device 74 is radially disposed, with respect to the axis 24, so that its radially disposed, generally cylindrical inner end 82 projects into the passage 58. The radially disposed outer end 84 of the device 74 is generally conically shaped and extends into the groove 42. A central radially disposed fluid passageway 86 permits fluid to flow from the passageway 58 into the groove 42. The size of the passageway 86 is selected so that a pre-selected flow rate of fluid will occur between the passage 58 and groove 42.

The devices 74, 76 and 78 are located, with respect to the groove 42, so as to seek to achieve a uniform distribution of fluid along the groove 42. More specifically, the dimensions of the passageways 86 in the devices 74, 76 and 78 are selected, with respect to the dimension of the annular gap 46 between the grooves 42 and 44, so that a pressure drop will be achieved along the gap 46 between the groove 42 and the groove 44 and so that there will be sufficient fluid pressure in the groove 42, and the adjacent portion gap 46, to maintain a substantial balance between the force of the pressurized fluid within the groove 42 (which groove would, of course, include the overlaid, adjacent portion of the gap 46) and the force exerted by a web on the outer tube 14 as the web passes about the roller 12. The fluid pressure is the lowest in the portion of the annular gap 46 adjacent to and including the groove 44. The location of the groove 42 is selected so that it is adjacent the portion of the outwardly facing surface 18 which comes in contact with the web as it passes about the roller 12. Fluid flowing through the passageways 86 impinge on the surface 22 of the tube 14. More specifically, the longitudinal axes of the fluid passageways 86 are generally aligned with the center of the groove 42 and usually with the web contact tangent point of the web, that is, the midpoint of the portion of the surface 18 which is in contact with the web as the web passes over the roller 12. However, the longitudinal axes 88 may be directed a small distance "downstream" from the web-contact tangent point on the surface 18. When this is done, the force of the fluid flowing through the passageways 86 will assist in the accelerating the tube 14 particularly after a zero speed splice has' been completed.

Annular, radially outwardly extending bearing collars 92 and 94 are mounted on the right and left ends 26 and 28, respectively, of the outer tube 14. The collars 92 and 94 are press-fit and are-secured by an adhesive (e.g. an epoxy) on the ends of the tube 14 so that the collars rotate with the tube 14. Annular, radially outwardly extending bearing collars 96 and 98 are mounted, by press fitting, on the ends 36 and 38, respectively, of the tube 16 and are disposed, side-by-side and adjacent to the collar 92 and 94, respectively.

The collars 92 and 96 and the collars 94 and 98 have similar construction and function and, consequently, only the collars 94 and 98 will be described in detail. The collar 94 has a surface 102 that is disposed in a radial plane with respect to the axis 24 and that faces the collar 98 and faces away from the collar 92. Similarly, the collar 98 has a surface 104 that is disposed in a radial plane with respect to the axis 24 and that faces the collar 94 (and the surface 102) as well toward the collars 92 and 96. These facing surfaces 102 and 104 are adjacent each other and are separated by a relatively small gap 106 that allows limited fluid flow from the annular gap 46 out to the atmosphere. The gap 106 creates a cushioned spacer between the collars 94 and 98.

Labrynth style grooves 108 are in the facing surfaces 102 and 104 and assist in controlling the flow of fluid through the gap 106. Although in FIGS. 1 and 2 the labrynth grooves 108 are shown as being in both surfaces 102 and 104; preferably, the grooves 108 are only in one of these surfaces.

The bearing collars 92–98 may be made from Delrin (brown Delrin) or other plastic material having similar properties.

The foregoing is a description of the preferred embodiment of the present invention. It should, however, be understood that the invention is not limited to the preferred embodiment, so described, since modifications and changes may be made by those skilled in the art, particularly in light of the foregoing descriptions and teachings. It is therefore contemplated that the following claims, and not the foregoing descriptions, should be the measure of the scope of the invention.

What is claimed is:

1. An improved, low inertia, relatively frictionless roller for handling high speed, fragile webs, the improved roller comprising:

a source of compressible fluid that has a preselected pressure;

an inner tube that has a radially outwardly facing surface; that has a first end and a second end; and that has a longitudinal central axis extending between the first and second ends;

an outer, web contacting tube that has a first end and a second end; that has a longitudinal central axis extending between the first and second ends of the outer tube; that is disposed about the inner tube so that the longitudinal central axes of the inner and outer tubes are coaxial and so that the outer tube may rotate about the coaxial central axes with respect to the inner tube; that has a radially outwardly facing surface partially circumferentially extending, that has a radially inwardly facing surface;

the inwardly facing surface of the outer tube and the outwardly facing surface of the inner tube defining therebetween an annular gap that has a preselect radial thickness, that has a first, partially circumferentially extending portion adjacent to the partially circumferentially extending portion of the outer tube which is in contact with a web as the web passes about the roller and that has a second, partially circumferentially extending portion spaced circumferentially from the first portion;

a first compressible fluid passage that is in the inner tube and that is in fluid communication with the compressible fluid source;

a second compressible fluid passage that is in the inner tube, that exhausts compressible fluid from the inner tube, and that is in fluid communication with the second portion of the annular gap; and a fluid flow restriction device that is in the inner tube that includes a fluid flow path which permits the flow of compressible fluid, in a preselectedly restricted manner, from the first passage to the first portion of the annular gap, with the radial dimension of the annular gap being selected so that there is a reduction in the pressure of the compressible fluid as the compressible fluid passes from the first portion of the annular gap to the second portion of the annular gap and so that the force of the web passing around the web portion of the outer tube is substantially balanced by the pressure of the compressible fluid in the first portion of the annular gap.

2. The improved roller as described in claim 1 wherein the first portion of the annular gap is substantially diametrically opposite the second portion of the air gap; and wherein the flow restriction device includes a plurality of longitudinally spaced flow paths.

3. The improved roller as described in claim 2 wherein the flow paths are directed downstream of the tangent point of contact between the web and the outer tube.

4. The improved roller as described in claim 1 wherein the outwardly facing surface of the inner tube includes a first longitudinally extending groove that has a longitudinal axis and that is adjacent to and is in fluid communication with the first portion of the annular gap; and wherein the fluid flow restriction device is in fluid communication with the first longitudinally extending groove.

5. The improved roller as described in claim 4 wherein the first longitudinally extending groove extends from adjacent the first end of the outer tube to adjacent the second end of the outer tube.

6. The improved roller as described in claim 5 wherein the first and second ends of the inner tube extend beyond the first and second ends, respectively, of the first longitudinally extending groove; and wherein the longitudinal axis of the first longitudinally extending groove is substantially parallel with the coaxial central axes of the inner and outer tubes.

7. The improved roller as described in claim 4 wherein the volume of the first longitudinally extending groove is greater than the volume of the first portion of the annular gap.

8. The improved roller as described in claim 7 wherein the inner tube includes a second longitudinally extending groove that has a longitudinal axis and that is adjacent and is in fluid communication with the second portion of the annular gap; and wherein the second passage is in fluid communication with the second longitudinally extending groove.

9. The improved roller as described in claim 8 wherein the second longitudinally extending groove extends from adjacent the first end of the outer tube to adjacent the second end of the outer tube.

10. The improved roller as described in claim 9 wherein the first and second ends of the outer tube extend beyond the first and second ends, respectively, of the second longitudinally extending groove; and wherein the longitudinal axis of the second longitudinally extending groove is substantially parallel with coaxial central axes of the inner and outer tubes.

11. The improved roller as described in claim 8 wherein the volume of the second longitudinally extending groove is greater than the volume of the second portion of the annular gap.

12. The improved roller as described in claim 1, wherein the first and second ends of the inner tube extend beyond the first and second ends, respectively, of the outer tube; wherein the first and second ends of the inner tube have an outwardly extending first and second bearings, respectively, with the first bearing having a bearing surface that faces toward the second bearing and with the second bearing having a bearing surface that faces toward the first bearing; wherein the first and second ends of the outer tube have outwardly extending first and second bearings, respectively, with the first bearing of the outer tube having a bearing surface that faces away from the second bearing of the inner tube and with the second bearing of the outer tube having a bearing surface that faces away from the first bearing of the inner tube; wherein the bearings surface of one of the two first bearings is disposed at an angle, with respect to the coaxial central axes of the inner and outer tubes; wherein the bearing surface of the other of the two first bearings is disposed at the same angle as the bearing surface of the one of the two first bearings; and wherein the bearing surfaces of the two first bearings are disposed adjacent to each other so as to define a restrictive fluid flow gap therebetween; wherein the bearing surfaces of one of the two second bearings is disposed at an angle, with respect to the coaxial central axes of the inner and outer tubes; wherein the bearing surface of the other of the two second bearings is disposed at the same angle as the bearing surface of the one of the two second bearings; and wherein the bearing surfaces of the two first bearings are disposed adjacent to each other so as to define a restrictive fluid flow gap therebetween.

13. The improved roller of claim 12, wherein the bearing surfaces of the two first bearings and the bearings surfaces of the two second bearings are disposed in planes substantially perpendicular to the coaxial central axes of the inner and outer tubes.

14. The improved roller of claim 12 wherein a first labyrinth groove is in at least one of the facing bearing surfaces of the two first bearings; and wherein a second labyrinth groove is in at least one of the facing bearing surfaces of the two second bearings.

15. The improved roller as described in claim 2 wherein the outwardly facing surface of the inner tube includes a first, longitudinally extending groove that has a longitudinal axis and that is adjacent to and is in fluid communication with the first portion of the annular gap; wherein the fluid flow restriction device is in fluid communication with the first longitudinally extending groove; wherein the inner tube includes a second, longitudinally extending groove that has a longitudinal axis and that is adjacent to and is in fluid communication with the second portion of the air gap; and wherein the second passage is in fluid communication with the second longitudinally extending groove.

16. The improved roller as described in claim 15 wherein the first and second ends of the inner tube extend beyond the first and second ends, respectively, of the first longitudinally extending groove; wherein the longitudinal axis of the first longitudinally extending groove is substantially parallel with the coaxial central axes of the inner and outer tubes; wherein the first and second ends of the outer tube extend beyond the first and second ends, respectively, of the second longitudinally extending groove; and wherein the longitudinal axis of the second longitudinally extending groove is substantially parallel with the coaxial central axes of the inner and outer tubes.

17. The improved roller as described in claim 16 wherein the flow paths are directed downstream of the tangent point of contact between the web and the outer tube.

18. The improved roller as described in claim 16 wherein the volume of the first longitudinally extending groove is greater than the volume of the first portion of the annular gap; and wherein the volume of the second longitudinally extending groove is greater than the volume of the second portion of the annular gap.

19. The improved roller as described in claim 18 wherein the first and second ends of the inner tube have an outwardly extending first and second bearings, respectively, with the first bearing having a bearing surface that faces toward the second bearing and with the second bearing having a bearing surface that faces toward the first bearing; wherein the first and second ends of the outer tube have outwardly extending first and second bearings, respectively, with the first bearing of the outer tube having a bearing surface that faces away from the second bearing of the inner tube and with the second bearing of the outer tube having a bearing surface that faces away from the first bearing of the inner tube; wherein the bearing surface of one of the two first bearings is disposed at an angle, with respect to the coaxial central axes of the inner and outer tubes; wherein the bearing surface of the other of the two first bearings is disposed at the same angle as the bearing surface of the one of the two first bearings; and wherein the bearing surface of the two first bearings are disposed adjacent to each other so as to define a restrictive fluid flow at therebetween; wherein the bearing surfaces of one of the two second bearings is disposed at an angle, with respect to the coaxial central axes of the inner and outer tubes; wherein the bearing surface of the other of the two second bearings is disposed at the same angle as the bearing surface of the one of the two second bearings; and wherein the bearing surfaces of the two first bearings are disposed adjacent to each other so as to define a restrictive fluid flow gap therebetween.

20. The improved roller as described in claim 19 wherein the bearing surfaces of the two first bearings and the bearing surfaces of the two second bearings are disposed in planes substantially perpendicular to the coaxial central axes of the inner and outer tubes; wherein a first labyrinth groove is in at least one of the facing bearing surfaces of the two first bearings; and wherein a second labyrinth groove is in at least one of the facing bearing surfaces of the two second bearings.

21. The improved roller as described in claim 20 wherein the webs, which are in contact with the outer tube, are utilized in the manufacture of disposable diapers; wherein the first groove extends from adjacent the first end of the outer tube to adjacent the second end of the outer tube; and wherein the second groove extends from adjacent the first end of the outer tube to adjacent the second end of the outer tube.

* * * * *